US006312571B1

(12) United States Patent
Nara et al.

(10) Patent No.: US 6,312,571 B1
(45) Date of Patent: Nov. 6, 2001

(54) ACTIVATED CATHODE AND PROCESS FOR PREPARATION THEREOF

(75) Inventors: Miwako Nara; Masashi Tanaka; Yoshinori Nishiki; Shuji Nakamatsu, all of Kanagawa (JP)

(73) Assignee: Permelec Electrode Ltd., Kanagawa (JP)

( * ) Notice: Subject to any disclaimer, the term of this patent is extended or adjusted under 35 U.S.C. 154(b) by 0 days.

(21) Appl. No.: 09/511,989

(22) Filed: Feb. 24, 2000

(30) Foreign Application Priority Data

Feb. 24, 1999 (JP) ..... 11-045810

(51) Int. Cl.[7] ..... C25B 9/00

(52) U.S. Cl. ..... 204/252; 204/290.01; 204/290.04; 204/290.1; 204/290.12; 204/290.14; 427/126.3; 427/226; 427/227; 427/383.1; 427/419.2; 427/419.3

(58) Field of Search ..... 204/290.01, 290.04, 204/290.1, 290.12, 290.14, 252; 427/126.3, 226, 227, 383.1, 419.2, 419.3

(56) References Cited

U.S. PATENT DOCUMENTS 6,077,415 * 6/2000 Duruz et al. ..... 204/290.1

* cited by examiner

*Primary Examiner*—Bruce F. Bell
(74) *Attorney, Agent, or Firm*—Sughrue, Mion, Zinn, Macpeak & Seas, PLLC

(57) ABSTRACT

An activated cathode comprising an electrically conductive substrate, an interlayer comprising a nickel oxide formed on the surface of the electrically conductive substrate, and a catalyst layer containing at least one lanthanum component selected from oxides and hydroxides of lanthanum metals and at least one platinum component selected from platinum metals and silver and oxides and hydroxides thereof formed on the interlayer. A process for the preparation of an activated cathode is also disclosed which comprises forming an interlayer comprising a nickel oxide on the surface of an electrically conductive substrate, and then forming a catalyst layer containing at least one lanthanum component selected from oxides and hydroxides of lanthanum metals and at least one platinum. component selected from platinum metals and silver and oxides and hydroxides thereof on the surface of the interlayer.

11 Claims, No Drawings

ACTIVATED CATHODE AND PROCESS FOR PREPARATION THEREOF

FIELD OF THE INVENTION

The present invention relates to an activated cathode having a good adhesivity and a prolonged life which allows for stable electrolysis, particularly of brine, and a process for preparing the same.

BACKGROUND OF THE INVENTION

In the electrolysis industry, the reduction of energy consumption is of great importance. In particular, a great deal of attention has been directed to lowering the bath voltage.

Combined with the industrialization of brine electrolysis using an ion exchange membrane, the use of an insoluble metal electrode made of a noble metal oxide as an anode can almost completely eliminate primary factors responsible for the rise in bath voltage. On the other hand, low carbon steel, which has heretofore been used as a cathode material, results in a hydrogen overvoltage considerably as high as 300 to 400 mV. Substitutes for this carbon steel that have recently been used include stainless steel, nickel and a nickel-plated material. However, these substitutes leave something to be desired in achieving the object of lowering the hydrogen overvoltage.

In order to lower the overvoltage by increasing surface area, some approaches have been attempted such as a method involving the elution of certain components from an alloy deposit, a method involving plasma spraying of a particle material and a method involving suspension plating. However, the cathode obtained by these methods is disadvantageous in that it has a roughened surface that can damage the ion exchange membrane and leaves something to be desired in the effect of lowering the bath voltage.

A method for lowering the cathode overvoltage that has recently been mainly used involves coating a nickel substrate with a platinum metal or oxide thereof as a catalyst component. Known examples of coating with a platinum metal oxide include a method which comprises applying a solution containing a platinum metal oxide to a heated metal substrate, and then calcining the coated material to form an oxide of ruthenium or the like on the surface thereof (JP-B-55-22556 (The term "JP-B" as used herein means an "examined Japanese patent application")), a method which comprises attaching a powder of an oxide of ruthenium or the like to the surface of a substrate with nickel by suspension plating (JP-B-59-48872, JP-B-60-13074), and a method which involves forming a composite oxide of metals such as nickel and ruthenium (JP-A-59-232284 (The term "JP-A" as used herein means an "unexamined published Japanese patent application")). The cathode prepared by these methods provides a low hydrogen overvoltage which is hardly affected by impurities such as iron in the electrolyte. However, since these methods involve the use of an unstable oxide as a cathode, the resulting cathode has insufficient durability and thus is disadvantageous in that it often operates for a reduced period of time.

On the other hand, a cathode is known comprising a platinum metal, particularly platinum or an alloy thereof, chemically deposited on a substrate made of nickel or the like (JP-A-57-23083). This cathode provides a low hydrogen overvoltage and has a high durability, but is disadvantageous in that it is liable to become poisoned by impurities such as iron in the electrolyte. In other words, such a platinum-coated cathode is very sensitive to impurities in the electrolyte, particularly iron ion. Accordingly, the platinum-coated cathode can lose its low hydrogen overvoltage activity even in the presence of iron ion in an amount of as small as not more than 1 ppm. However, because most electrolysis apparatus and its piping are formed from an iron-containing material, it is extremely difficult to avoid the presence of iron ion in the electrolyte, unavoidably causing deterioration of the cathode.

In order to overcome these difficulties, a cathode for electrolysis has been proposed comprising a catalyst layer coating the cathode containing at least one of a platinum metal, a platinum metal oxide and a platinum metal hydroxide and at least one of cerium, cerium oxide and cerium hydroxide (JP-B-6-33492). In general, cerium is chemically active and thus can hardly be present in a caustic soda solution. Further, since cerium has a poor electrical conductivity, it can easily add to the resistance of the foregoing coating layer. Thus, cerium has been said to be impractical as a cathode catalyst for the electrolysis of brine. However, when mixed with the foregoing platinum metal components to provide a composite coating layer, the cerium component can be extremely stable in a high concentration alkali to obtain a low hydrogen overvoltage cathode coat having both excellent durability and resistance to poisoning and sufficient electrical conductivity. This is presumably because the cerium component in the coating layer forms a cerium hydroxide difficultly soluble in a high concentration alkali and adds to the overvoltage for the reaction of deposition of iron on the platinum metal component.

However, since the above cathode having high activity and resistance to poisoning by iron is coated only with a porous catalyst layer on the substrate thereof, it leaves something to be desired in the adhesivity between the catalyst coat and the substrate. Accordingly, the catalyst coat containing a platinum metal component and a cerium component can be peeled off from the substrate or can partially fall off from the substrate. When these defects occur, the substrate can be exposed to the high concentration aqueous solution of alkali to undergo corrosion, considerably reducing the electrode life. Further, the substrate can be dissolved in the high concentration aqueous solution of alkali, adding to the content of contaminants in the product.

SUMMARY OF THE INVENTION

It is therefore an object of the present invention to provide an activated cathode which is less liable to peeling or flaking of the catalyst coat to make effective use of inherent high activity and resistance to poisoning and a process for preparing the same.

The above object of the present invention will become apparent from the following detailed description and examples.

The above object of the present invention has been accomplished by providing an activated cathode comprising an electrically conductive substrate having a surface, an interlayer comprising a nickel oxide formed on the surface of the electrically conductive substrate, and a catalyst layer containing at least one lanthanum component selected from the group consisting of oxides and hydroxides of lanthanum metals and at least one platinum component selected from the group consisting of platinum metals and silver and oxides and hydroxides thereof formed on the interlayer.

The above object of the present invention has also been accomplished by a process for preparing an activated cathode which comprises forming an interlayer comprising a nickel oxide on a surface of an electrically conductive substrate, and then forming a catalyst layer containing at least one lanthanum component selected form the group consisting of oxides and hydroxides of lanthanum metals and at least one platinum component selected from the group consisting of platinum metals and silver and oxides and hydroxides thereof on the surface of the interlayer.

DETAILED DESCRIPTION OF THE INVENTION

The present invention will be further described hereinafter.

In the present invention, an interlayer comprising a nickel oxide is interposed between an electrically conductive substrate and a catalyst layer. The interlayer prevents a high concentration caustic soda as a strong alkali produced by the electrolysis of the electrolyte such as brine from penetrating into the substrate to corrode the substrate and elute impurities therefrom. Further, if the interlayer comprising a nickel oxide is formed by the oxidation of the surface of the electrically conductive substrate made of nickel on the surface thereof, the resulting interlayer exhibits maximum adhesivity because the interlayer and the substrate are originally one with each other. Thus, the interlayer thus formed is not liable to peeling or flaking.

The electrically conductive substrate is preferably made of stainless steel, titanium, nickel and carbon material from the standpoint of electrical conductivity and chemical stability. It is particularly preferred to use an electrically conductive substrate made of nickel at least on the surface thereof because it can be calcined to form a nickel oxide layer as an interlayer integrally on the surface thereof. Even if the substrate and the interlayer are not integrally formed, the nickel on the surface of the substrate and the nickel in the interlayer have good affinity for each other to thereby enhance adhesivity between the two layers. The thickness and voids of the electrically conductive substrate are not specifically limited. In practice, however, the thickness and porosity of the electrically conductive substrate are preferably from about 0.05 to 5 mm and from about 10 to 95%, respectively.

In the case where the electrically conductive substrate is calcined to oxidize the surface thereof and hence form a nickel oxide as an interlayer, the electrically conductive substrate must be made of nickel at least on the surface thereof. The substrate need only be heated and calcined in air to form the interlayer. Oxygen in the air and nickel in the surface layer of the substrate react with each other to produce a nickel oxide $N_{(1\times x)}O$. Although depending on the production conditions, this nickel oxide normally has an oxygen defect and thus exhibits p-type semiconductivity. The calcining temperature is from 350 to 550° C. The calcining time is preferably from 5 to 60 minutes.

On the other hand, where an interlayer is independently formed on the surface of the electrically conductive substrate, the surface of the electrically conductive substrate is preferably roughened to enhance its adhesivity to the interlayer. A blasting method involving spraying with a powder, an etching method using a soluble acid or a plasma spray coating method may be used as the roughening method. In order to remove particulate contaminants such as metal and organic material from the surface of the substrate, a chemical etching method is preferably employed. In this case, the electrically conductive substrate is preferably consumed in an amount of from 50 to 500 g/m$^2$.

Subsequently, a nickel oxide layer is formed as an interlayer on the roughened surface of the electrically conductive substrate. The nickel oxide layer can be formed, e.g., by a process which comprises applying to the surface of the substrate a coating solution containing nickel ion obtained by dissolving nickel nitrate or nickel sulfate in nitric acid or sulfuric acid, diluting the solution with water, drying the coating material, and then subjecting the coated material to thermal decomposition. If a solution comprising nickel chloride and hydrochloric acid in combination is used as a coating solution, the substrate is excessively corroded at the coating, drying and calcining steps to lower adhesion to the surface of the substrate. This makes it difficult to obtain an interlayer having a sufficient thickness. In other words, it is important for the coating solution to be acidic and form and maintain a stable nickel oxide on the surface of the substrate. Further, the coating solution needs to be made of a compound and a solvent which does not excessively corrode the substrate.

When the interlayer formed by directly heating the substrate or by applying a coating solution to the substrate and then calcining the coated material is too thick, this results in considerable resistive loss. On the contrary, when the interlayer thus formed is too thin, the substrate may not be sufficiently protected. Accordingly, the interlayer is preferably formed to an optimum thickness of from 0.1 to 100 $\mu$m.

Subsequently, the surface of the interlayer thus formed is covered by a catalyst layer. The catalyst layer is formed as a mixed coating layer containing at least one of oxides and hydroxides of lanthanum metals (hereinafter referred to as a "lanthanum component") and at least one of platinum metals and silver and oxides and hydroxides thereof (hereinafter referred to as a "platinum component"). The platinum component and lanthanum component in the catalyst layer are sufficiently resistant to poisoning by iron ions or the like which are very likely to contaminate the electrolyte such as caustic soda, while also allowing the platinum component to maintain its effect of lowering the hydrogen overvoltage. The catalyst layer is preferably formed by a process which comprises applying a coating solution having any of a nitrate, sulfate, ammine complex and nitro complex of lanthanum metals, platinum metals and/or silver dissolved therein to the surface of the interlayer, and then subjecting the coating to thermal decomposition.

The lanthanum metal is a general term for elements having an atomic number of from 57 to 71, namely, lanthanum, cerium, praseodymium, neodymium, promethium, samarium, europium, gadolinium, terbium, dysprosium, holmium, erbium, thulium, ytterbium and lutetium. In the present invention, cerium is most preferably used. In some detail, cerium may be dissolved in the coating solution in the form of cerium nitrate or cerium sulfate. In the activated cathode of the invention, cerium is present in the form of cerium oxide or cerium hydroxide.

The platinum metals include platinum, palladium, ruthenium and iridium. Besides these platinum metals, silver may be used as a catalyst metal. These metals may be used in elemental form, or as an oxide or hydroxide. Platinum, if used, is preferably dissolved in the coating solution in the form of a dinitrodiamminate. Ruthenium, if used, is preferably dissolved in the coating solution as ruthenium nitrate.

The mixing ratio of platinum metal to lanthanum metal is preferably from 40:60 to 80:20 by mol%. The coating solution having various catalyst metal salts dissolved therein is applied to the surface of the substrate on which an interlayer has been formed, dried, and then calcined to form a catalyst layer. Drying may be effected at a temperature of 40 to 80° C. for 5 to 20 minutes. Calcining may be effected at a temperature of from 350 to 550° C. for 5 to 60 minutes.

The catalyst layer thus formed may be thick. However, since expensive noble metals are used, the optimum thickness of the catalyst layer is from about 0.1 to 10 μm, and the optimum covering amount of the catalyst is from about 0.5 to 5 g/m$^2$ of the cathode surface.

Where the cathode of the invention is used in the electrolysis of brine, the ion exchange membrane for use as a separating membrane is most appropriately a corrosion-resistant fluororesin-based membrane. The cathode is preferably brought into close contact with the foregoing ion exchange membrane to lower the bath voltage. In this arrangement, the cathode substrate needs to be porous to facilitate the escape of gas generated by the electrolysis. Further, the anode for use as an opposing electrode is preferably an insoluble electrode (DSE, DSA) coated with a noble metal oxide. In most cases, the anode is also placed in contact with an ion exchange membrane. Thus, the anode is preferably porous similarly to the cathode. The various members may be mechanically bound to each other before beginning electrolysis. Alternatively, these membranes may be bonded to each other under a pressure of from about 0.1 to 30 kgf/cm$^2$ during electrolysis. The electrolysis of brine may be effected, e.g., at a temperature of from 60 to 90° C. and a current density of from 10 to 100 A/dm$^2$.

In the present invention, an interlayer is formed on the surface of the substrate. The interlayer makes it possible to prevent the salt solution from reaching and corroding the substrate while preventing metallic nickel in the substrate from contaminating the catalyst layer as nickel ion. In most cases, the cathode of the invention is used in contact with the ion exchange membrane during electrolysis. When nickel contaminates the catalyst layer, it migrates from the cathode to the ion exchange membrane, to the anode in some cases, possibly adversely effecting the ion exchange membrane or anode. As described above, by preventing nickel ion from contaminating the interior of the catalyst layer, the ion exchange membrane and anode are also indirectly protected.

The present invention will be further described in more detail by reference to the following examples, but the present invention should not be construed as being limited thereto.

EXAMPLE 1

An electrolysis bath having an electrolysis area of 100 cm$^2$ (width: 5 cm; height: 20 cm) was prepared as follows.

As the cathode substrate, a nickel mesh (pore diameter: 8 mm (major) and 6 mm (minor); thickness: 1 mm) was used which had been thoroughly roughened with particulate alumina (#60), and then etched with a boiling 20 wt % hydrochloric acid. The cathode substrate was then calcined in a 500° C. air atmosphere in a calcining furnace for 20 minutes to form an interlayer of nickel oxide on the surface thereof.

Cerium nitrate and platinum dinitrodiamminate were then dissolved in a 8 wt % nitric acid as a solvent at a molar ratio of 1:1 to prepare a coating solution having a total concentration of 5% by weight. The coating solution thus prepared was applied to both surfaces of the nickel mesh using a brush, dried at a temperature of 60° C., and then calcined at a temperature of 500° C. in an electric furnace for 20 minutes. This procedure was repeated three times. Ultimately, an activated cathode having a catalyst coverage of 4 g/m$^2$ was prepared. A section of the nickel substrate on which a catalyst layer had been formed was then analyzed by an electron beam mass analyzer. As a result, the catalyst layer was found to be free of nickel component, demonstrating that the nickel oxide constituting the interlayer prevents the substrate from being eluted.

The above cathode and a titanium DSE porous anode were then brought into contact with opposing sides of a Nafion 981 (produced by Du Pont) ion exchange membrane to form an electrolysis bath. Electrolysis was then effected at a temperature of 90° C. and a current of 50 A while saturated brine was supplied as an anolyte to the anode chamber at a rate of 4 ml per minute and pure water was supplied to the cathode chamber at a rate of 0.4 ml per minute. As a result, the bath voltage was 3.35 V. A 33% caustic soda was obtained from the outlet of the cathode chamber at a current efficiency of 97%. After 10 days of electrolysis (energization was suspended for one of the ten days), the bath voltage increased by 10 mV, but the current efficiency remained at 97%. The electrolysis bath was then disassembled for analysis of the ion exchange membrane. As a result, the ion exchange membrane was found to have no nickel deposited thereon.

EXAMPLE 2

A coating solution prepared by dissolving nickel nitrate in a 8 wt % nitric acid as a solvent to a concentration of 5% by weight was applied to the same cathode substrate as used in Example 1. The coated material was then calcined in a 500° C. air atmosphere calcining furnace to form a nickel oxide on the surface thereof. Cerium nitrate and platinum dinitrodiamminate (molar ratio: 1:1) were dissolved in a 8 wt % nitric acid as a solvent to prepare a coating solution having a total concentration of 5% by weight. The coating solution thus prepared was applied to both sides of the substrate in portions, dried at a temperature of 60° C., and then calcined at a temperature of 500° C. in an electric furnace for 20 minutes. This operation was repeated three times to prepare an activated cathode having a final catalyst coverage of 4 g/m$^2$. A section of the nickel substrate on which a catalyst layer had been formed was then analyzed by an electron beam mass analyzer. As a result, the catalyst layer was found to be free of nickel component, demonstrating that the nickel oxide constituting the interlayer prevents the substrate from being eluted.

The same electrolysis bath as used in Example 1 was assembled except that the above cathode was used. Electrolysis was then effected under the same conditions as described above. As a result, the bath voltage was 3.30 V. A 33% caustic soda was obtained from the outlet of the cathode chamber at a current efficiency of 97%. After 10 days of electrolysis (energization was suspended for one day of the ten days), the bath voltage increased by 10 mV, but the current efficiency remained at 97%. The electrolysis bath was then disassembled for the analysis of the ion exchange membrane. As a result, the exchange membrane was found to have no nickel deposited thereon.

COMPARATIVE EXAMPLE 1

An electrode was prepared in the same manner as in Example 1 except that no interlayer was formed. A section of the electrode thus prepared was then analyzed. As a result, a nickel component from the substrate was found to have contaminated the catalyst layer. The electrode was then used to form an electrolysis bath. Electrolysis was then effected under the same conditions as in Example 1. In the initial stage of electrolysis, the bath voltage reached 3.30 V. A 32% caustic soda was obtained from the outlet of the cathode chamber at a current efficiency of 96%. After 10 days of electrolysis (energization was suspended for one day of the ten days), the bath voltage increased by 50 mV, and the current efficiency was reduced to 94%. The electrolysis bath was then disassembled for analysis of the ion exchange membrane. As a result, the ion exchange membrane was found to have been colored brown partially on the surface thereof. Thus, nickel was found deposited on the ion exchange membrane.

COMPARATIVE EXAMPLE 2

The same electrode as used in Example 1 was prepared, except that a chloroplatinate was used as the starting material of the catalyst instead of cerium nitrate and platinum dinitrodiamminate. A section of the electrode thus prepared was then observed. As a result, a nickel component from the interlayer was found to have contaminated the catalyst layer. The electrode was then used to form an electrolysis bath. Electrolysis was then effected under the same conditions as in Example 1. In the initial stage of electrolysis, the bath voltage reached 3.30 V. A 32% caustic soda was obtained from the outlet of the cathode chamber at a current efficiency of 96%. After 10 days of electrolysis (energization was suspended for one day of the ten days), the bath voltage increased by 50 mV, and the current efficiency was reduced to 95%. The electrolysis bath was then disassembled for analysis of the ion exchange membrane. As a result, the ion exchange membrane was found to have been colored brown partially on the surface thereof. Thus, nickel was found deposited on the ion exchange membrane.

The activated cathode according to the present invention comprises an electrically conductive substrate, an interlayer comprising a nickel oxide formed on the surface of the electrically conductive substrate, and a catalyst layer containing at least one of oxides and hydroxides of lanthanum metals and at least one metal selected from the group consisting of platinum metals and silver and oxides and hydroxides thereof formed on the interlayer.

The cathode comprises an interlayer comprising a nickel oxide formed thereon. In this arrangement, the substrate can be protected against severe conditions such as heating and calcining during its preparation. Further, ingredients such as nickel contained in the substrate cannot contaminate the interior of the catalyst layer. While maintaining the platinum component and lanthanum component capable of exerting an effect of lowering the hydrogen overvoltage and an effect of protecting against poisoning by iron or the like, the above arrangement protects the substrate and prevents the catalyst layer from contamination by foreign matter, thus prolonging the cathode life.

Further, by forming a substrate having nickel at least on the surface thereof, nickel is contained in both the substrate and the interlayer, making it possible to further enhance the adhesivity between the two layers. The lanthanum metal to be incorporated in the catalyst layer is preferably cerium, which can fairly maintain the platinum metal resistant to poisoning.

The present invention also concerns a process for the preparation of an activated cathode which comprises forming an interlayer comprising a nickel oxide on the surface of an electrically conductive substrate, and then forming a catalyst layer containing at least one of oxides and hydroxides of lanthanum metals and at least one metal selected from the group consisting of platinum metals and silver and oxides and hydroxides thereof on the surface of the interlayer.

In the present invention, an interlayer made of a nickel oxide may be formed as a part of the substrate by calcining the substrate. This arrangement provides a cathode having high strength and prolonged life free from peeling or flaking of the interlayer.

The metal salt to be incorporated in the coating solution is preferably a nitrate or sulfate rather than a chloride. Otherwise, the substrate can be excessively corroded to lower the electrode strength. This defect can be avoided by using a nitrate or sulfate.

The catalyst layer is preferably formed by a process which comprises applying a coating solution containing any of a nitrate, sulfate, ammine complex and nitro complex of lanthanum metals, platinum metals and/or silver dissolved therein to the surface of the interlayer, and then subjecting the coating to thermal decomposition. In this manner, a cathode having a high activity can be obtained.

While the invention has been described in detail and with reference to specific embodiments thereof, it will be apparent to one skilled in the art that various changes and modifications can be made therein without departing from the spirit and scope thereof.

What is claimed is:

1. An electrolytic cell partitioned by a membrane into a cathode chamber containing an activated cathode and an anode chamber containing an anode, said activated cathode comprising an electrically conductive substrate having a surface, an interlayer mainly comprising a nickel oxide formed on the surface of said electrically conductive substrate, and a catalyst layer containing at least one lanthanum component selected from the group consisting of oxides and hydroxides of lanthanum metals and at least one platinum component selected from the group consisting of platinum metals and silver and oxides and hydroxides thereof formed on said interlayer.

2. The electrolytic cell as claimed in claim 1, wherein the surface of said electrically conductive substrate comprises nickel, and said lanthanum component comprises at least one cerium oxide and cerium hydroxide.

3. The electrolytic cell as claimed in claim 1, wherein the electrically conductive substrate has a thickness of from about 0.5 to 5 mm and a porosity of from about 10 to 95%.

4. The electrolytic cell as claimed in claim 1, wherein the interlayer has a thickness of from 0.1 to 100 $\mu$m.

5. The electrolytic cell as claimed in claim 1, wherein the catalyst layer has a thickness of from about 0.1 to 10 $\mu$m.

6. The electrolytic cell as claimed in claim 1, wherein the catalyst layer has a coverage of from about 0.5 to 5 g/m$^2$ of the cathode surface.

7. The electrolytic cell as claimed in claim 1, wherein said membrane is an ion exchange membrane, and said anode and activated cathode are in contact with opposing sides of the ion exchange membrane.

8. A process for the preparation of an activated cathode which comprises forming an interlayer comprising a nickel oxide on a surface of an electrically conductive substrate, and then forming a catalyst layer containing at least one lanthanum component selected from the group consisting of oxides and hydroxides of lanthanum metals and at least one platinum component selected from the group consisting of platinum metals and silver and oxides and hydroxides thereof on the surface of said interlayer, which forming step comprises applying a coating solution having a nitrate or sulfate of nickel dissolved therein to said electrically conductive substrate, and then subjecting the coating to thermal decomposition to form an interlayer comprising a nickel oxide thereon.

9. A process for the preparation of an activated cathode which comprises forming an interlayer comprising a nickel oxide on a surface of an electrically conductive substrate, and then forming a catalyst layer containing at least one lanthanum component selected from the group consisting of oxides and hydroxides of lanthanum metals and at least one platinum component selected from the group consisting of platinum metals and silver and oxides and hydroxides thereof on the surface of said interlayer, which forming step comprises applying to the surface of said interlayer a coating solution having at least one of a nitrate, sulfate, ammine complex and nitro complex of lanthanum metals, platinum metals and/or silver dissolved therein, and then subjecting the coating to thermal decomposition to form a catalyst layer thereon.

10. A process for the preparation of an activated cathode which comprises forming an interlayer comprising a nickel oxide on a surface of an electrically conductive substrate, and then forming a catalyst layer containing at least one lanthanum component selected from the group consisting of oxides and hydroxides of lanthanum metals and at least one platinum component selected from the group consisting of platinum metals and silver and oxides and hydroxides thereof on the surface of said interlayer, which forming step comprises applying to the surface of said interlayer a coating solution having at least one of a nitrate, sulfate, ammine complex and nitro complex of lanthanum metals and at least one of a nitrate, sulfate, ammine complex and nitro complex of platinum metals and/or silver dissolved therein, and then subjecting the coating to thermal decomposition to form a catalyst layer thereon.

11. A process for the preparation of an activated cathode which comprises forming an interlayer comprising a nickel oxide on a surface of an electrically conductive substrate, and then forming a catalyst layer containing at least one lanthanum component selected from the group consisting of oxides and hydroxides of lanthanum metals and at least one platinum component selected from the group consisting of platinum metals and silver and oxides and hydroxides thereof on the surface of said interlayer, which forming step comprises applying to the surface of said interlayer a coating solution having at least one of a nitrate or sulfate of lanthanum metals and at least one of a nitrate and sulfate of platinum metals and/or silver dissolved therein, and then subjecting the coating to thermal composition to form a catalyst layer thereon.

* * * * *